United States Patent [19]

Swift

[11] Patent Number: 4,793,644

[45] Date of Patent: Dec. 27, 1988

[54] SECURITY SEAL WITH DYE

[75] Inventor: Allan W. Swift, Denville, N.J.

[73] Assignee: E. J. Brooks Company, Newark, N.J.

[21] Appl. No.: 167,705

[22] Filed: Mar. 14, 1988

[51] Int. Cl.[4] ..... B65D 33/34

[52] U.S. Cl. ..... 292/320

[58] Field of Search ..... 242/307 R, 316, 318, 242/319, 320, 321; 109/29; 70/18

[56] References Cited

U.S. PATENT DOCUMENTS

| | | | |
|---|---|---|---|
| 3,344,757 | 10/1967 | Touyet | 109/29 X |
| 3,375,033 | 3/1968 | Moberg | 292/320 |
| 3,441,304 | 4/1969 | Chidley et al. | 292/307 R |
| 3,463,532 | 8/1969 | Chidley et al. | 292/307 R |
| 3,485,521 | 12/1969 | Moberg | 292/320 |
| 3,838,878 | 10/1974 | Fernberg et al. | 292/318 |
| 3,991,594 | 11/1976 | Goenna | 70/53 X |
| 4,226,194 | 10/1980 | Grahn | 109/29 X |
| 4,278,281 | 7/1981 | Moberg | 292/320 |
| 4,326,741 | 4/1982 | Wilson | 292/307 R |
| 4,353,583 | 10/1982 | Moberg | 292/320 |
| 4,687,240 | 8/1987 | Swift | 292/320 |

*Primary Examiner*—Richard E. Moore

*Attorney, Agent, or Firm*—John G. Gilfillan, III; Jeremiah G. Murray

[57] ABSTRACT

A security seal having a plastic body including three elongated parallel chambers. Mating with the body is a U-shaped resilient shackle having a pair of legs each having a reversely bent end portion terminating in a sharp edge for insertion in two of the chambers. The third chamber in the body contains a frangible ampule containing a liquid dye. When used to seal a structure, the shackle is threaded through the structure, and the legs are inserted into the chambers. The sharp edges of the reversely bent end portions are flexed into tight engagement with the interior walls of the chambers. In this locked position, any tampering with the security seal that would cause the shackle to move in a direction opposite to the direction in which the shackle was inserted in the body would result in the sharp edges of the reversely bent end portions penetrating the walls of the chamber, entering the third chamber, shattering the ampule, and permitting the liquid dye to seep from the security seal body to give a visual indication of tampering.

13 Claims, 2 Drawing Sheets

SECURITY SEAL WITH DYE

BACKGROUND OF THE INVENTION

The present invention relates to security seals and more particularly to security seals of the padlock type that include means for providing visual evidence of tampering.

Security seals of the padlock type are generally well known, and they have found wide spread use as a means for sealing structures such as currency bags, closures, electric meters, and the like. Examples of such seals may be found in the following U.S. Pat. Nos.: 3,375,033; 3,485,521; 4,278,281; 4,353,583 and 4,687,240. All of these seals generally have a plastic body with a pair of spaced cavities and a U-shaped shackle having ends that are permanently locked in the cavities when the seals are used. A number of these prior art seals have been designed to produce a visual indication of tampering. For example, in U.S. Pat. No. 4,687,240, the seal body is made of a pigmented plastic of a type which produces a white blush when deformed. If tampering occurs, the shackle deforms the plastic body to produce a milky white appearance that is readily visible. Additionally, because the shackle has sharp ends to deform the plastic, the shackle ends will, in some cases, protrude from the seal body giving an added visual indication of tampering. Other examples of visual indicators may be found in the above cited prior art.

As can be seen from these prior art references, those concerned with the development of security seals have long recognized the need for improvements in means that provide visual evidence of tampering. Other attempts at such improvements in non-padlock type security seals include the use of a dye that will seep from the seal onto the surrounding structures when tampering occurs. Examples of such prior art devices may be found in the following U.S. patents: U.S. Pat. Nos. 3,991,594; 3,463,532; and 4,326,741. These patents generally describe security seals having a chamber in which a dye is stored. When the chamber is penetrated the dye is ejected. As such, the dye will stain the outer surface of the tubing and/or stain the surrounding structures and even the hands of the person tampering with the tube. The advantages of such dye filled security seals are numerous. One such advantage being that it becomes easier to determine, even from substantial distances, that the seal has been compromised. More important, such dyes can provide on-site evidence that tampering has occurred plus evidence of the person or tools used to effect the tampering.

One of the most critical problems confronting developers of such seals has been the overall cost of producing, shipping, and using such seals. The padlock type security seal has long been recognized as one of the most economical and practical solutions to the design of seals in general. Such seals are easy to operate and are not susceptible to accidental breakage during use. The present invention retains most of the advantages of such prior art padlock type seals while also providing an inexpensive, highly reliable, versatile means of providing visual evidence of seal tampering.

SUMMARY OF THE INVENTION

In accordance with the present invention, a seal of the padlock type, having a plastic body with a pair of apertures therein for receiving a resilient wire shackle, is provided with means for ejecting dye therefrom during tampering. The shackle is generally U-shaped with legs having reversely bent, sharp ends that are dimensioned to be maintained in a flexed condition when inserted into the seal body. The extreme ends of the bent legs are provided with sharp edges, so they will readily pierce the interior walls of the seal if the shackle is moved in a direction opposite to the direction of insertion. Therefore, pulling the shackle with sufficient force will cause the sharp ends to enter a chamber in which a frangible ampule containing a liquid dye is stored. As a result, the shackle will shatter the ampule, the dye will seep from holes in the plastic body, and the dye will stain the surrounding structure to give visual evidence of tampering.

The exact nature of this invention, as well as other objects and advantages thereof, will be readily apparent from consideration of the following specification relating to the annexed drawings in which:

DESCRIPTION OF THE PREFERRED EMBODIMENT

Figure 1:
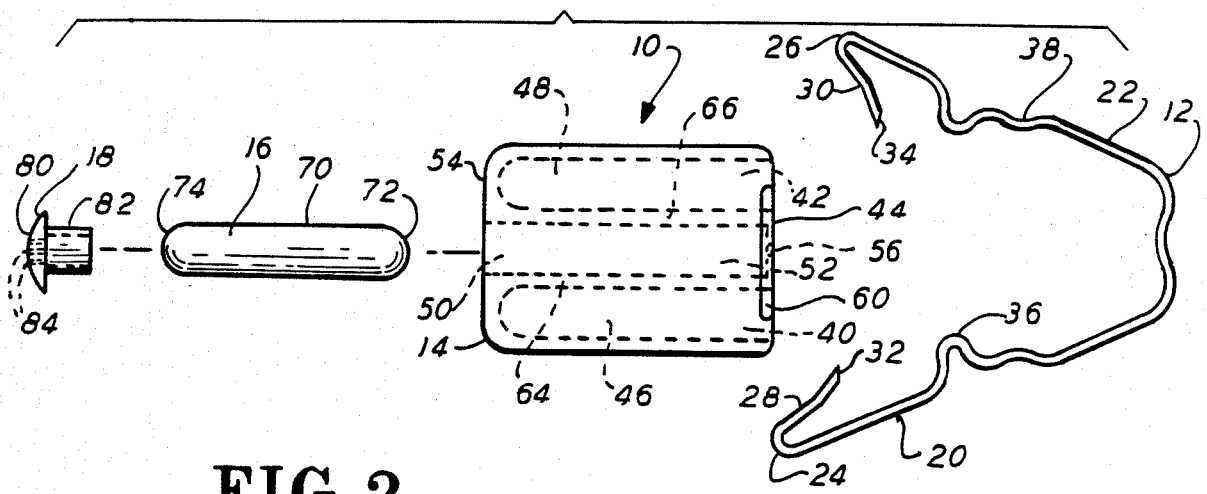
FIG. 1 shows an exploded plan view of a preferred embodiment of the invention.

Referring now to the drawings, wherein like reference characters designate like or corresponding parts throughout the several views, there is shown a security seal 10 having a shackle 12, a body 14, an ampule 16, and an end cap 18. Shackle 12, formed of a spring wire and shown in FIG. 1 in its unstressed position, is generally a U-shaped structure having a long leg 20 and a short leg 22. The legs 20 and 22 have bights 24 and 26 forming reversely bent end portions 28 and 30, respectively. Formed on the extreme ends of bent end portions 28 and 30 are sharpened edges 32 and 34, respectively. Finally, the legs 20 and 22 are each bent to form protruding bumps 36 and 38, respectively.

The body 14, generally shaped as a flat rectangular block, has spaced apertures 40 and 42 extending into the body 14 from end wall 44 to form elongated chambers 46 and 48, respectively. A third aperture 50 is formed in end wall 54 which is parallel to and located opposite end wall 44 on body 14. Aperture 50 extends into body 14 to form a third chamber 52 intermediate chambers 46 and 48. Chamber 52 runs from end wall 54 to a distance just short of end wall 44. A vent hole 56 in end wall 44 intersects the chamber 52 for venting the interior of chamber 52 to the exterior of body 14 through wall 44. A pair of parallel reinforcing ribs 60 and 62 are formed on the opposite side edges of end wall 44. Chambers 46 and 52 are separated by partition 64, and chambers 48 and 52 are separated by partition 66.

Ampule 16 is constructed from a thin brittle material, such as plastic or glass, and defines a hollow elongated cylindrical body 70 having closed, generally rounded ends 72 and 74. Ampule 16 contains a liquid 95 that will be later described in detail.

Cap 18 has a cylindrical sleeve 82 having an outside diameter substantially equal to the inside diameter of aperture 50. At one end, sleeve 82 is closed by a smooth rounded head 80 extending radially beyond the outside surface of sleeve 82. Holes 84 extend axially through the head 80 into the interior of sleeve 82.

Figure 2:
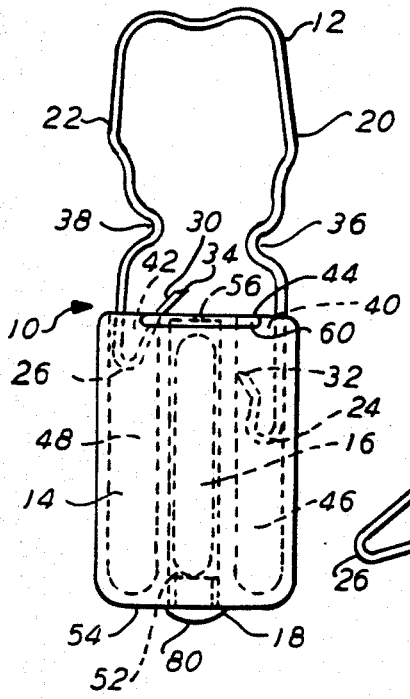
FIG. 2 shows a plan view of the device shown in FIG. 1 in a storage position.
Figure 3:
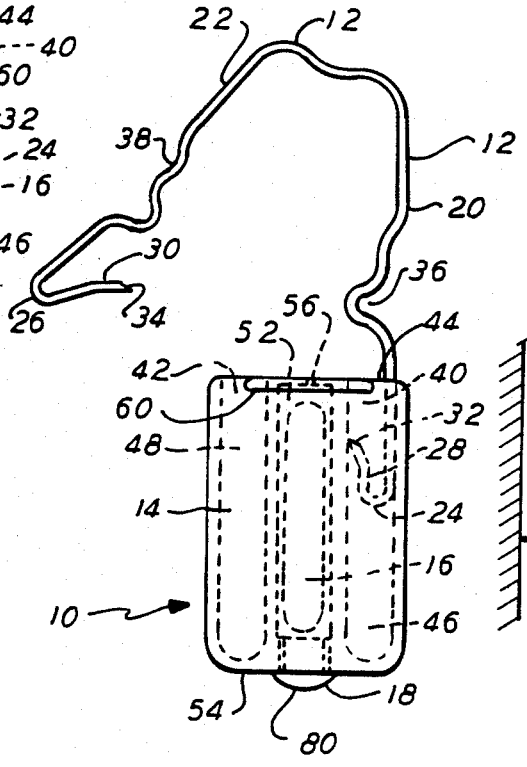
FIG. 3 shows a plan view of the device shown in FIG. 1 in an open position.
Figure 4:
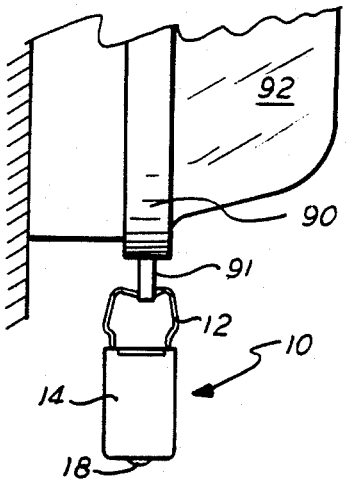
FIG. 4 shows a plan view of the device shown in FIG. 1 mounted on a structure in a locked position.
Figure 5:
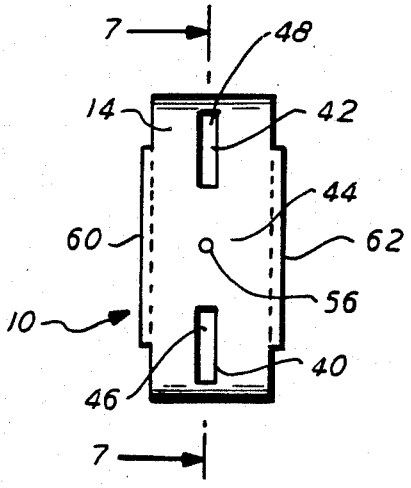
FIG. 5 is an end view of the device shown in FIG. 1.
Figure 6:
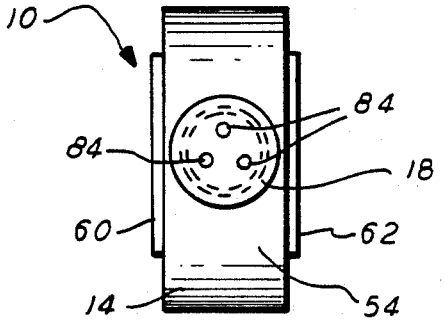
FIG. 6 is an end view of the device shown in FIG. 1.

FIG. 1 illustrates the security seal 10 before assembly, while FIG. 2 represents an assembled security seal 10 as it would normally be shipped or supplied to a user. FIG. 3 illustrates the security seal 10 in an open position, i.e., ready for mounting the seal 10 onto a structure. FIG. 4 shows a fully locked seal 10 mounted on a structure, such as an electric meter rim 90. Assembly of the seal 10 of FIG. 1 into the assembled structure of FIG. 2 involves first sliding the liquid containing ampule 16 into chamber 52 through aperture 50 and then fitting sleeve 82 of cap 18 into aperture 50 with the head 80 abutting the wall 52. Cap 18 is permanently joined to body 14 as, for example, by an ultrasonic weld or other suitable means. The shackle 12 is assembled by squeezing the spring wire legs 20 and 22, and inserting first bite 24 and then bite 26 into opposed apertures 40 and 42. As the legs 20 and 22 are forced into the apertures 40 and 42, the walls of chambers 46 and 48 will squeeze the legs 20 and 22, bend the end portions 28 and 30 at bites 24 and 26, and force the sharpened edges 32 and 34 into tight engagement against the surface of partitions 64 and 66. It is contemplated that the seal 10 could be shipped and supplied to the user in the condition shown in FIG. 2, that is, with the long leg 20 partially inserted in chamber 46 and with the bite 26, on the short leg 22, clipped in the other aperture 42. With the seal 10 in this position, the shackle 12 and body 14 are assured to remain joined, preventing other seals 10 from becoming tangled therewith during shipping. Also, with the bite 26 on the short leg 22 only slightly inserted in the body 14, the seal can be opened and put into the open position shown in FIG. 3 by simply grasping the short leg 22 and, with only minimal force, bending the bite 26 out of the aperture 42.

With the shackle 12 in the open position, shown in FIG. 3, the seal 10 is in a position to have the short leg 22 threaded onto the structure to be sealed, such as the lug 91 on electric meter 92, as shown in FIG. 4. After threading the short leg 22 through lug 91, the short leg 22 is replaced in aperture 42, and the shackle 12 is fully inserted into the body 14 to the locked position shown in FIGS. 4 and 7.

Figure 7:
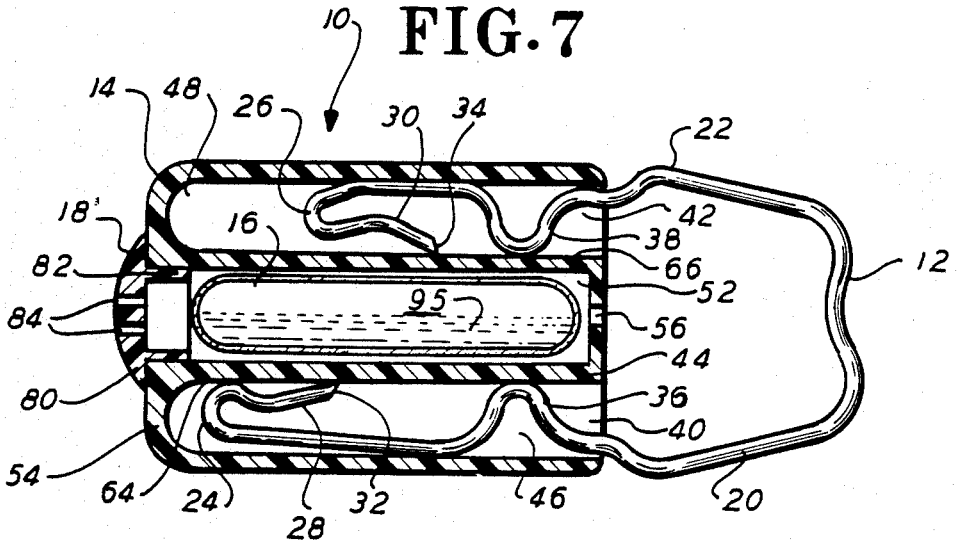
FIG. 7 is a section of the device taken on the line 7—7 of FIG. 5.

When the seal 10 is in the fully locked position of FIGS. 4 and 7, the sharpened edges 32 and 34 are in tight engagement against the partitions 64 and 66 due to the resilient nature of the spring wire material of shackle 12 and the squeezing of end portions 28 and 30 during insertion of legs 20 and 22 into body 14. Also, as can be seen in FIG. 7, when the shackle 12 is fully inserted into body 14, the bumps 36 and 38 are contained in the chambers 46 and 48, respectively. These bumps 36 and 38 are provided to block entry into the chambers 46 and 48 of a picking tool.

Figure 8:
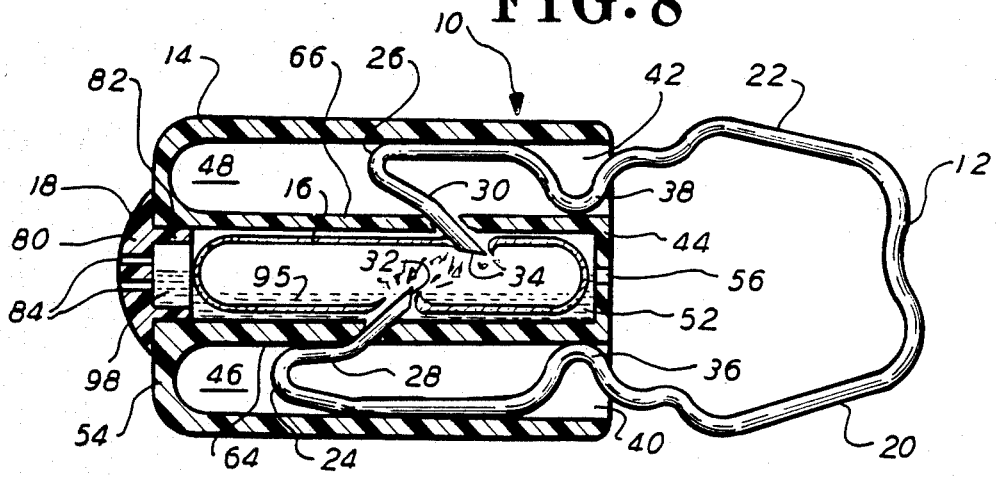
FIG. 8 is a sectional view of the preferred embodiment similar to the view shown in FIG. 7 but in a tampered position.

It is contemplated that the material, preferably plastic, of the body 14 be soft so that the partitions 64 and 66 are easily punctured by the sharpened edges 32 and 34 when any reasonable attempt is made to remove the legs 20 and 22 of the shackle 12 from the body 14. If such an attempt to remove the shackle 12 should take place, it is intended that the sharp edges 32 and 34 will puncture the partitions 64 and 66, enter the chamber 52, and shatter the brittle ampule 16, as shown in FIG. 8. In this final position, shown in FIG. 8, it is contemplated that the liquid 95 will seep from the shattered ampule 16, come in contact with the walls of chamber 52, and, eventually, be discharged from the body 14 through holes 84, or through the vent hole 56. For the seal to be effective in all climates, it is necessary that the liquid 95 remain viscous at low temperatures. To those skilled in the art, the names of numerous chemical dyes for use as liquid 95 will be evident. In some cases it may be advantageous that the liquid 95 not be visible to the tamperer. It is contemplated that in such cases, the liquid 95 may be an indelible colorless ink that could be made visible with special means, such as ultraviolet light.

After seeping from the ampule 16, the liquid 95 may also seep through the pierced openings in the partitions 64 and 66, into the chambers 46 and 48, and through apertures 40 and 42 to the exterior of body 14. It can be seen, therefore, there are provided multiple paths for the seeping liqiud 95 to reach the exterior of seal 10.

It should be understood, of course, that the foregoing disclosure relates to only a preferred embodiment of the invention, and that numerous other modifications or alterations may be made therein without departing from the spirit and the scope of the invention as set forth in the appened claims. For example, in the foregoing disclosure the legs 20 and 22 are described and shown as being locked in chambers 46 and 48 by virtue of the sharp edges 32 and 34 digging into the soft partitions 64 and 66. Other locking methods are also feasible, such as the use of bumps, slots, depressions, etc., that are easily penetrated when tampering occurs.

What is claimed is:

1. A security seal comprising:

a seal body having adjacent first and second chambers therein;

a liquid contained in said first chamber; and a shackle having at least one leg including means for locking said leg in said second chamber and for rupturing said first chamber to permit said liquid to seep from said first chamber when a force is exerted to unlock said leg.

2. A security seal according to claim 1 and wherein said liquid is transparent in the presence of visible light.

3. A security seal according to claim 2 and wherein said liquid is of such composition that it can be visually detected upon exposure to radiation outside the visible light range.

4. A security seal comprising:

a resilient shackle having at least one leg with a reversely bent end portion terminating in a sharp edge;

a seal body having a first chamber therein for receiving said reversely bent end portion;

a second chamber positioned in said body adjacent said first chamber and separated therefrom by a partition;

a liquid contained in said second chamber;

said reversely bent end portion being bent through an angle such that said sharp edge is compressed against said partition when said reversely bent end portion is inserted, in a first direction, into said chamber; and wherein the compressive force of said sharp edge against said partition and the strength of said partition are such that upon sufficient movement of said shackle in said first chamber, in a direction opposite to said first direction, said sharp edge will penetrate said partition and enter said second chamber, whereby said liquid will seep from said seal body.

5. A security seal according to claim 4 and wherein said liquid is transparent in the presence of visible light.

6. A security seal according to claim 5 and wherein said liquid is of such composition that it can be visually detected upon exposure to radiation outside the visible light range.

7. A security seal comprising:

a U-shaped resilient shackle having first and second legs, each having a reversely bent end portion terminating in a sharp edge;

a seal body having spaced elongated first and second generally parallel chambers, each terminating in an aperture located in a common wall on said seal body for receiving a different one of said legs;

a third chamber positioned in said body adjacent said first and second chambers and separated therefrom with first and second partitions, respectively;

a liquid contained in said third chamber;

the unstressed width of the bent ends of each of said first and second legs being greater than the width of each of said first and second chambers, such that said reversely bent end portions are compressed by the chamber wall and said sharp edges are forced against said partitions when said legs are slideably inserted in a first direction into said chambers; and wherein the force of said sharp edges and the strength of said partitions are such that upon sufficient movement of said shackle, in a direction opposed to said first direction, said sharp edges will penetrate said partitions, enter said third chamber, and cause said liquid to be discharged from said third chamber.

8. A security seal according to claim 7 and wherein said liquid is transparent in the presence of visible light.

9. A security seal according to claim 8 and wherein said liquid is of such composition that it can be visually detected upon exposure to radiation outside the visible light range.

10. A security seal comprising:

a U-shaped resilient shackle having first and second legs, each having a reversely bent end portion terminating in a sharp edge;

a seal body having spaced elongated first and second generally parallel chambers, each terminating in an aperture located in a common wall on said seal body for receiving one of said shackle legs;

a third chamber positioned in said body adjacent said first and second chambers and separated therefrom with first and second partitions, respectively;

a frangible ampule having a liquid therein located in said third chamber;

said reversely bent end portions being bent through an angle such that said sharp edges are compressed against the walls of said partitions when said legs are slideably inserted in a first direction into said chambers; and wherein the compressive force of said sharp edges against said partitions and the strength of said partitions are such that, upon sufficient movement of said shackle in said chambers in a direction opposed to said first direction, said sharp edges will penetrate said partitions, enter said third chamber, and shatter said ampule, whereby said liquid will seep onto the walls of said third chamber.

11. A security seal according to claim 10 and wherein said liquid is transparent in the presence of visible light.

12. A security according to claim 10 and wherein said liquid is of such composition that it can be visually detected upon exposure to radiation outside the visible light range.

13. A security seal according to claim 10 and further including at least one opening formed in said seal body extending between said third chamber and the exterior of said seal, wherby upon release of said liquid from said ampule, at least a portion of liquid will pass out of said third chamber through said at least one opening.

* * * * *